United States Patent [19]

Babbidge

[11] 4,317,478

[45] Mar. 2, 1982

[54] SELF-CLOSING, SNAP-OPEN POUCH AND METHOD OF MAKING SAME

[76] Inventor: Lewis E. Babbidge, 16374 Euclid Ave., Cleveland, Ohio 44112

[21] Appl. No.: 43,000

[22] Filed: May 29, 1979

Related U.S. Application Data

[63] Continuation-in-part of Ser. No. 656,228, Feb. 9, 1976, abandoned.

[51] Int. Cl.[3] ..... B65D 33/30

[52] U.S. Cl. ..... 150/10; 229/65

[58] Field of Search ..... 150/3–5, 150/42, 10; 206/260, 264; 229/62, 65

[56] References Cited

U.S. PATENT DOCUMENTS

| | | | |
|---|---|---|---|
| 488,783 | 12/1892 | Weber | 229/65 |
| 1,224,842 | 5/1917 | Boyd | 150/10 X |
| 1,798,945 | 3/1931 | Lamarthe | 150/10 |
| 2,232,888 | 2/1941 | Schimelmitz | 150/10 |
| 2,903,033 | 9/1959 | Robinson | 150/10 |
| 3,272,248 | 9/1966 | O'Farrell | 150/10 |

FOREIGN PATENT DOCUMENTS

| | | | |
|---|---|---|---|
| 1209370 | 3/1960 | France | 150/42 |
| 347264 | 4/1931 | United Kingdom | 150/10 |

*Primary Examiner*—Stephen Marcus

*Attorney, Agent, or Firm*—Albert L. Ely, Jr.

[57] ABSTRACT

Self-closing, snap-open pouch or sack type of flexible container having closure emore transversely flexible in one direction than in the other under longitudinal load and/or more outwardly flexible at or toward its center than at its ends. Opposed transverse creases adjacent the ends of each closure strip insure that the strips will spring apart under a longitudinal compressive load applied substantially to both strips. The walls of the containers are made from sheet material with a pair of closure strips secured to the sheet margins; longitudinal center folding of the sheet brings the closure strips into opposed juxtaposition and allows the folded sheet to be severed and end-sealed to form individual containers and place the ends of one closure element in a pivotal relationship with the ends of an opposite closure element.

3 Claims, 7 Drawing Figures

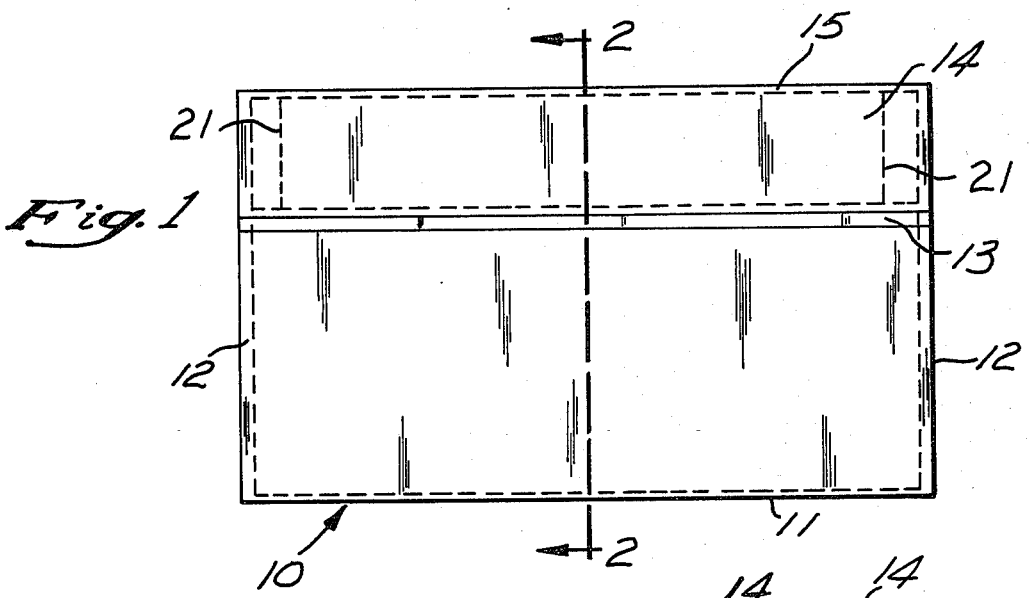
Fig. 1
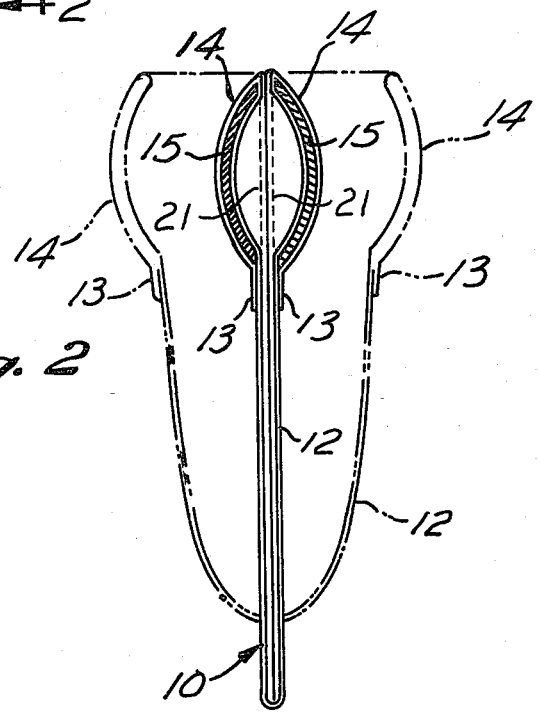
Fig. 2
Fig. 3
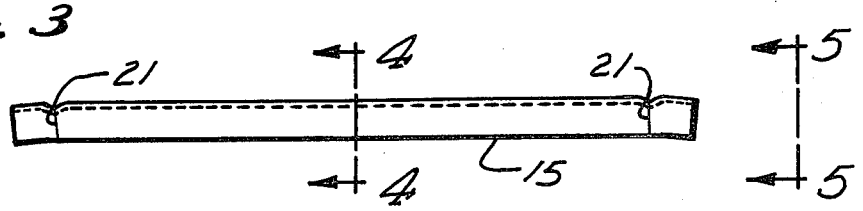
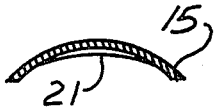
Fig. 4
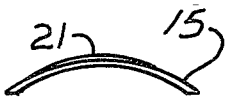
Fig. 5

SELF-CLOSING, SNAP-OPEN POUCH AND METHOD OF MAKING SAME

This application is a continuation-in-part of my prior application for "Self-closing, snap-open pouch and method of making same", Ser. No. 656,288, filed Feb. 9, 1976, now abandoned.

This invention relates to improvements in pouch or sack type of flexible containers, the mouths of which are normally self-closing due to biased closure means which bring opposed sides of the mouth or portions of the mouth together but which may be snapped open, usually by pressing or squeezing the ends of the closure means. More particularly, this invention relates to such a self-closing, snap-opening pouch or sack type of container which can be readily mass-produced from far less expensive materials then generally used heretofore and to methods of mass-producing them from such materials.

Coin purses, tobacco pouches, and the like made of natural or artificial leather, fabric (often lined with relatively moisture-proof material), and other durable materials are well-known types of such self-closing, snap-open pouches which may be opened by pulling or forcing apart opposed and normally parallel members biased to close the container. Heretofore, the closure means of such a container (hereinafter inclusively referred to as a "pouch") frequently comprised four relatively stiff rods or strips hinged or otherwise pivotally joined together to form the sides of an articulated quadrilateral; springs or other biasing means normally urge one pair of the members into a position parallel with the other pair so as to normally close the opposite sides of the pouch to which the members are secured. Due to the complexity and expense of the closure means and the expense of the material from which the pouch itself is made, such prior art self-closing, snap-open pouches have heretofore usually been intended for use as relatively permanent and reusable items.

While as capable of re-use in the same manner as the above described prior art pouches, pouches made according to this invention are so simple and inexpensive that they are also suitable for throw-away original packages for merchandise and, if made of transparent flexible film, as display packages for merchandise constituting an assortment of items or sets of parts. This advantage and utility follow from the further advantage that pouches according to this invention may be mass-produced from inexpensive materials requiring only slight modification of, or accessories added to, standard equipment for producing conventional flexible pouches or sack-type packaging of heat-sealable film not equipped with such self-closing, snap-opening means. While the ends of opposed closure elements of this invention may bear against and pivot with respect to each other as the pouch is forced and held open, there are no hinges or pivot means, as such, nor are there required the heretofore conventional springs or like biasing means, as such.

An advantage of this invention is that its opposed closure elements comprise a pair of generally parallel and straight strips configured so as to be more flexible and, thus, to bow in one transverse direction rather than the other when subjected to a longitudinally compressive, i.e., columnar, load. Theoretically, when such strips are opposed, they will spring apart under such a columnar load, but, under such load in actual practice, one such strip will occasionally bow in the same direction as the other strip. A particular advantage of this invention is the discovery that slight creases in the strips adjacent the ends thereof unfailingly caused, in many repeated tests, such opposed closure strips to spring apart, rather than bow in the same direction, when subjected to a columnar load. By utilizing this discovery in this invention, there is no need for pull tabs or manipulations to cause the mouth of the pouch to open, rather than to remain closed, because pressure on the ends of the closure strips caused them to bow in the same direction.

Other objects and advantages of this invention will be apparent from the following specification, claims, and drawings, in which:

FIG. 1 is a side elevation showing, in its normally closed condition, an unfilled pouch made according to this invention.

FIG. 2 is a cross-section along the line 2—2 of FIG. 1, but showing in phantom the position of its elements when the pouch is snapped open; for clarity, details are omitted in the phantom showing.

FIG. 3 is a side elevation of a closure member employed in the pouch shown in FIG. 1; the angularity of the ends to the straight center portion of members is exaggerated for purposes of illustration.

FIG. 4 is a cross-section along the line 4—4 of FIG. 3.

FIG. 5 is an end view of the closure element shown in FIGS. 3 and 4.

Figure 6:
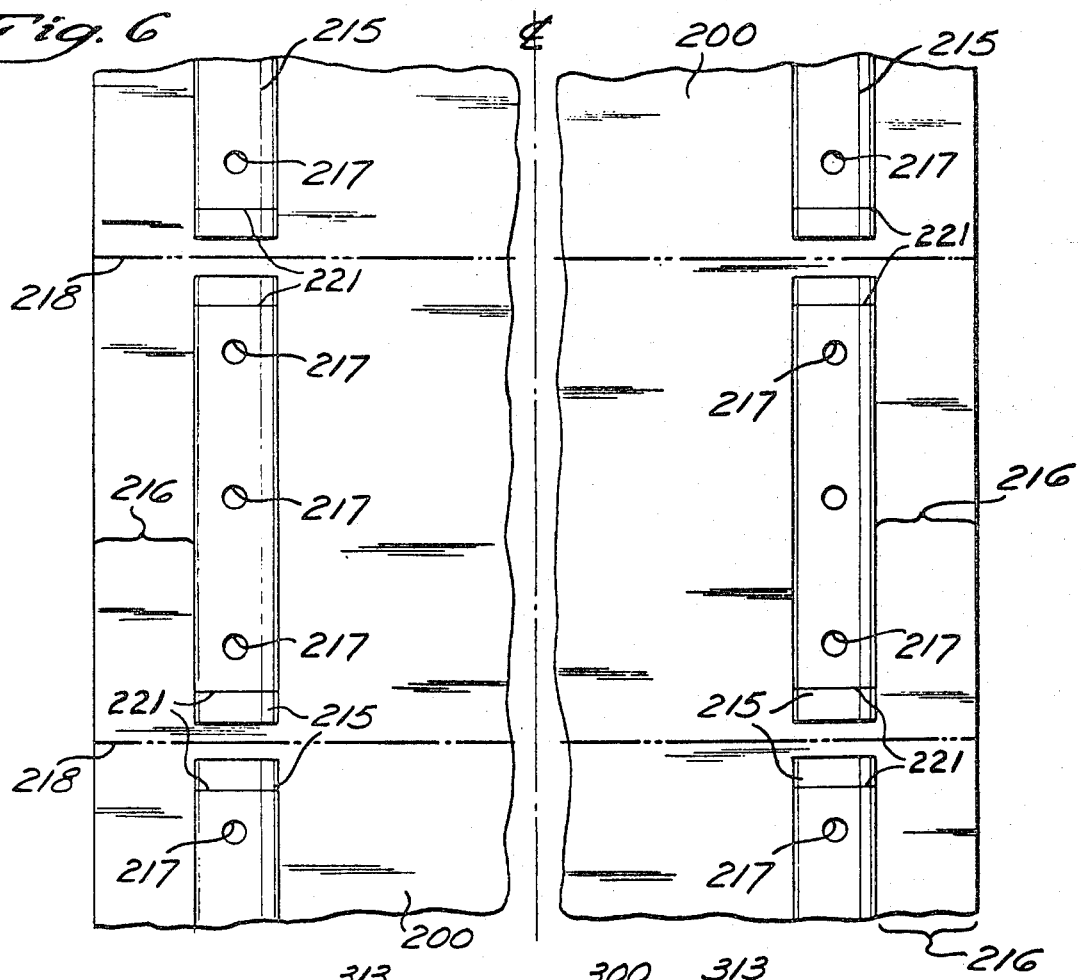
FIG. 6 is a fragmentary layout showing a stage of assembly of closure elements on the sheet material of the pouch wall material in the process of making a pouch as shown in FIG. 1, but with an optional modification of the closure elements.

Referring to FIGS. 1 and 2 of the drawings and the embodiment shown therein, 10 is a pouch made of a sheet of flexible sheet material, preferably a heat-sealable packaging film such as polyethylene or like readily heat-sealed polyolefin, without excluding any other flexible sealable films such as, for example, nitrile rubber-modified acrylonitrile methyl acrylate basic copolymer ("Barex 210") which may be employed because of its normally greater transparency despite its greater cost than the more common polyolefins. As in conventional pouch construction, the sheet material for the body 10 is center-folded to provide a fold 11 constituting the bottom of the pouch, which is closed at its ends by end seams 12. However, in this particular embodiment and others of this invention, before making or completing the end-seams 12, each length-wise margin of the sheet from which the pouch 10 is made is folded outwardly (in the embodiment shown) or inwardly and sealed to the sheet by the seam 13 to provide a pair of flat tubular cuffs 14. Each cuff 14 thus externally encloses and is substantially filled by a flexible closure strip 15 due to the preferably tight fit of the end-seams 12 against the ends of each of the pair of closure strips 15. These strips 15 are preferably "substantially" equal in length, i.e., as precisely equal in length as normal manufacturing tolerances permit. Thus, the ends of one strip 15 will be held tightly against the ends of the other strip 15 by the end-seam 12 so that, when the mouth of the pouch is opened as shown in phantom in FIG. 2, the end-seam 12 causes the respective congruent ends of the strips 15 to pivot on each other as though a pivot pin joined the corners of an end of one strip 15 in one cuff 14 to the corresponding corners of the adjacent end of the strip 15 enclosed in the other cuff 14. If the cuffs 14 fully enclose the strip 15 internally as well as externally so that the tightly fitting end-seals 12 comprise, at the ends of the strips 15, at least four plies of flexible sheet material from which the pouch 10 is made, at least two plies will be interposed between each pair of ends of the opposed strips 15. The thickness of most commercially available heat-sealable flexible packaging film is only in the order of a few mils or so and during the opening of the pouch by application of a columnar load on the closure strips the interposed plies of film do not interfere with the above described pivotal movement of the adjacent ends of the strips 15 as though they were mechanically joined by pivot pins or hinges. However, if the flexible material of the pouch 10 is more than seveal mils thick or otherwise offers insubstantial resistance to a shear load applied to its opposite surfaces, as in the case of cloth, leather, or the like, during the application of a columnar load to open the pouch the plies interposed between congruent ends of the opposed closure strips 15 can permit a slippage which will offset one closure strip with respect to the other. When an end of one closure strip 15 is offset with respect to the adjacent end of the other, the optimum desired pivotal movement is not obtained; rather, adjacent ends of offset closure strips tend to toggle with respect to each other under a columnar load and, thereby, and in the absence of other measures as described below, constituting one of the apparently cumulative causes for one closure strip to bow, under a columnar load, in the same direction as the other strip instead of the two strips bowing apart.

A key requisite for a self-closing, snap-open pouch made according to this invention and regardless of other measures is, therefore, the relatively "one-way" transverse flexibility of the closure strips 15. That is, in response to a transverse load at the center of a strip 15, the strip bends transversely in one direction under a lesser load than it will bend in response to the transverse load necessary to bend the strip 15 in the opposite direction; consequently, when subjected to a columnar or end-wise load, such a strip will also tend to bend in one specific direction tranverse to the endwise load in preference to bending in any other direction. Thus, in FIGS. 1 and 2, the closure elements 15 comprise two longitudinally straight thin strips, which may be of flexible metal or plastic having a sufficient modulus of elasticity to resist fracture or permanent distortion under the flexing to which it is subjected; along its length each is crowned or otherwise troughed to provide longitudinally extending convex and concave surfaces. A strip of such cross-section is an example of one which will flex at a lesser transverse load applied midway of its length to its concave surface than the transverse load necessary to flex the strip if applied midway of its length but to the convex surface.

Accordingly, as shown in FIG. 2, by enclosing the strips 15 in the cuffs 14 so that their concave surfaces oppose each other, and upon application of an end-wise load to the strips, as by squeezing the ends of the cuffs 14, the closure strips 15 and the cuffs 14 in which they are enclosed will theoretically (and usually do) bow outwardly away from each other, snapping open the mouth of the pouch defined by the cuffs 14. Once the pouch has been snapped open (the cross-sectional contours of the strips 15 in their central portions becoming more nearly that of a thin-walled cylinder and losing their normal convex-concave configuration), some endwise pressure (but noticeably less than initially required to snap the pouch open) is still necessary to hold the pouch open for access to its contents or to pour or shake out its contents. Upon release of such endwise pressure, the strips 15 quickly snap to their normal straight position, snapping the pouch closed.

As pointed out above, however, and in the absence of other measure, a pouch 10 enclosing in its cuffs 14 a pair of closure strips 15 so that their "one-way" flexibilities are opposed will not consistently snap the mouth of the pouch open when the ends of the strips are squeezed (usually between the thumb and forefinger of one hand) to apply a columnar load on the strip. Such failure of the closure strips to perform as, in theory, they would have to is frustrating and confusing to the user; opening has to be a two-handed operation in which the ends of the strips are squeezed in one hand while the other hand is used to pry or pull away one encuffed strip that happened to bow in the same direction as the other instead of bowing away. Such inconsistency of operation is also believed to be a reason why the prior art closure mechanisms employing hinges and springs have continued to be used commercially for snap opening and closing pouches.

Why two closure strips 15 having opposed and equally concave surfaces do not consistently bow apart under a columnar load is not fully understood, but appears to be due to one or more reasons having a cumulative effect, particularly in the relatively thin gauge material (economically and preferably employed for the strips 15) where the predominance of the tendency, under columnar load, to bow in the direction of its convex side, rather than oppositely, may be very slight. Thus: if (a) one otherwise equal strip is slightly stiffer, due to a slight deviation in the gauge of the strip material within normal manufacturing tolerances, it will "overpower" the other strip and cause it to bow in the direction of the stiffer strip. On the other hand, if (b) one otherwise equal strip is slightly shorter than the other, it will have a slightly greater columnar stiffness but usually be overpowered by the longer strip which will bow first and (c) if the columnar load is applied to one end of a pair of otherwise equal strips with a slightly lateral component so as to cause a slight shifting of the ends of the strip with respect to each other as the load is applied, both strips appear to tend to bow in the direction induced by the lateral component.

Several measures may be taken to minimize the above apparent causes for opposed closure strips 15 to bow together under a columnar load rather than apart and are therefore preferred in an embodiment of this invention: (i) The lengths of the pair of opposed strips are selected to be substantially equal; (ii) the strips 15 are tightly enclosed within the cuffs 14, particularly by the end-seams 12, to prevent shifting of the strips relatively to each other; (iii) the center portions of the strips may be weakened, as by lessening the concavity or narrowing the amount of material in the strips and thereby lessening the columnar load required to bow the strips; (iv) the cuffs 14 may be slit transversely and internally at their ends adjacent the end-seams 12 or the potions of the flexible packaging material at the ends of the inner walls of the cuffs 14 may be removed so that an end seam 12 at a cuff is comprised of only the material forming the external wall of the cuff whereby, in the completed pouch, the corners of the opposed ends of the strips 15 bear directly on each other without the interposition of plies of the packaging material.

With or without the latter two foregoing measures, one other measure has been discovered to be most effective in causing the strips 15 to bow apart under columnar load, namely: As shown in the drawings, particularly FIGS. 3 to 5, adjacent each end of a strip 15 having a generally arcuate cross-section throughout its length, as shown in FIGS. 2, 4, and 5, a crease 21 is made. The arcuate line of a crease 21 has a slightly greater radius than that of the arc of the concave-convex cross-section otherwise prevailing along the length of the strip 15 so as to cause each end of a strip to extend beyond the center portion of the strip between the creases 21 at a slight angle (in the order of 5°-10°) toward the concavity of the strip. The effect of such creases and the ends angled thereby appears to be twofold: (1) When a pair of such creased strips 15 are enclosed within the cuffs 14, the bearing of the corners of the ends of one strip 15 upon the corresponding opposite corners of the ends of the other strip 15 is virtually insured, thereby also insuring the pivoting of such opposed corners of the strips upon each other when the strips are subjected to a columnar load. (2) The center portions of the strips are slightly spaced apart between the creases 21, whereby the strips 15 are slightly "started" toward bowing away from each other when a columnar load is applied to ends of both strips enclosed in the cuffs 14.

The depth of a crease 21 at the edges of a strip 15 (a crease 21 being barely discernible, if at all, mid-way between the edges) and its distance from the adjacent end of the strip are factors empirically determined by the flexibility of the strips 15. In general, the length of the end of a strip 15 beyond a crease 21 and its obtuse angularity to the central portion of the strip should be sufficient to increase the spacing between the central portions of a pair of opposed strips by at least the gauge of a strip.

The foregoing measure of slightly starting opposed strips 15 to bow away from each other by means of creases 21 does not allow the mouth of the pouch 10 to close as tightly as if the strips 15 were straight throughout their lengths. Such incomplete closing of the mouth of the pouch is immaterial when the pouches are employed for packaging relatively large articles, such as nuts, bolts, or other hardware items. When the pouch is used for containing or packaging finely granulated material, such as face powder, pipe tobacco, and the like, the mouth of the pouch may be effectively sealed by adding a strip of readily compressible foam or sponge to the interior surface of a cuff 14.

A pouch 10, as above described, despite its relative complexity with respect to conventional bags, sacks, and pouches essentially consisting of flexible packaging films only, may be manufactured with minor modification of or addition of accessories to conventional flexible package manufacturing equipment.

Referring to FIG. 6, a web of packaging film 200, from which a pouch 10 is to be made, is fed from a large supply roll by the usual draw rolls onto a bed equipped with the usual "plowshares" for folding the web lengthwise. Before the web is led into the first pair of folding plowshares, successive lengths of spaced closure strips 215 are positioned in parallel files on the moving web adjacent the margins 216, each margin 216 being slightly wider than the closure strips 215. The closure strips 215 are identical with the crowned strips 15 shown in FIGS. 1 to 5 and have their ends angled toward the concavities of the strips 215 by means of the creases 221 except that the strips 215 are also provided with holes 217 that are pre-punched at the same time the creases 221 are formed. The holes 217 serve several purposes. Goffer wheels having slightly protruding pins or pegs engaging the holes 217 accurately position and space the members 215 on the web; the members 215 may be secured in their thus located positions adhesively or by heat-sealing or are held in position by draw rolls as the margins 216 are folded over the members 215 by folding plowshares and the edges of the margins 216 are then seamed to the body of the web by a heat-sealed seam (corresponding to the seam 13 shown in FIG. 1) to form a cuff (corresponding to the cuff 14 shown in FIG. 1) enclosing a file of spaced closure members on each side of the web 200. While the cuffs are thus being formed, heat-seal points may be used to heat-seal opposite sides of each cuff through the holes 217, thereby securely locking the members 215 in place within the cuff. With the cuffs formed and the closure members 215 positioned, the web 200 is folded on its longitudinal center line to bring the concave surface of the members 215 together. The web is then passed under a heat-sealing cut-off knife which severs the folded and cuffed web into pouch lengths indicated by the cut-off lines 218, end seams for the pouches being formed on either side of the lines 218. In the thus completed pouch there are two residual advantages of the positioning holes 217. They narrow the effective transverse width of the members 215 in their central portions which are stressed under columnar loads; the transverse stiffness of the members 215 is thereby lessened and pouches in which they serve as closure strips can be snapped open with slightly less endwise pressures on the closure strips and a lesser tendency of the closure strips to not bow apart. The holes 217 also permit the pouches to be hung on hooks passing through the holes 217 so that the pouches may be used as display packages.

Figure 7:
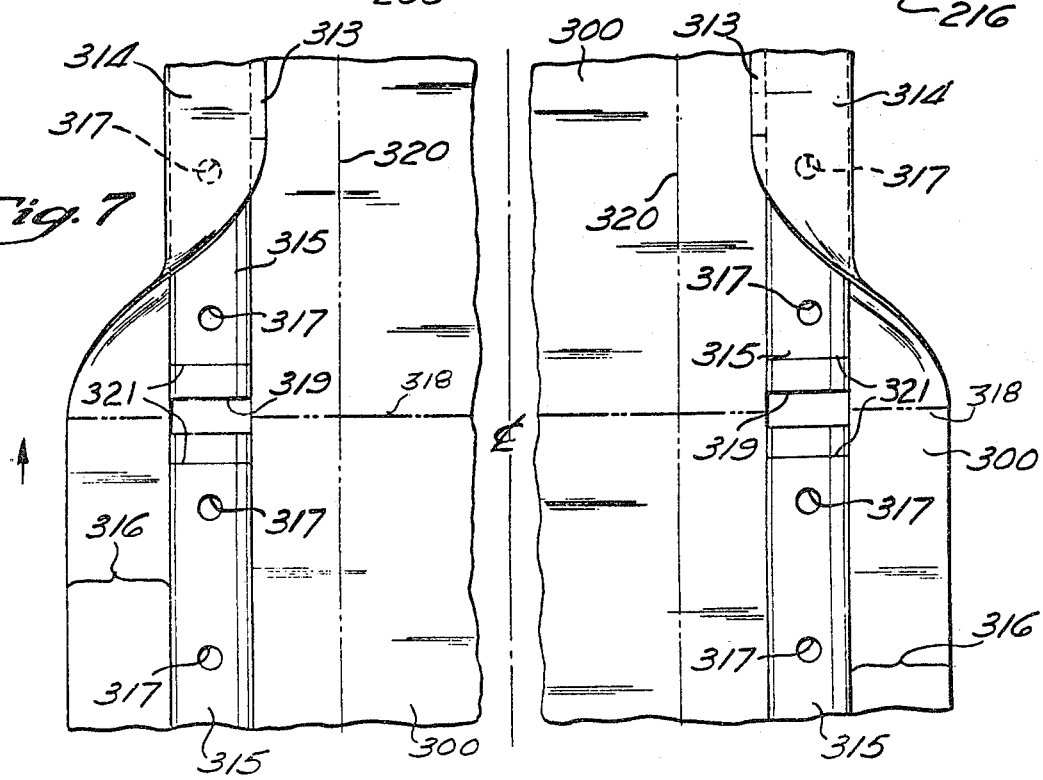
FIG. 7 is a fragmentary layout similar to FIG. 6 but showing a modification of the process.

A modified method of making pouches according to this invention is shown in FIG. 7. It eliminates the use of goffer wheels as employed in the method shown in FIG. 6 to position the closure strips and also eliminates plies of the packaging film interposed between the ends of the closure strips when the cuffs enclosing such strips are closed by end means of the pouches produced by this method. Thus, in such pouches the opposed corners of the ends of the closure strip bear and pivot directly on each other when the closure strips are subjected to a columnar load in order to snap the pouches open.

As shown in FIG. 7, a web of packaging film 300 is fed from a supply roll into a bed and, as it passes onto the bed, two continuous strips of stock for closure members 315, pre-punched with holes 317, are fed onto the web 300 so as to provide margins 316. As the web 300 and strips 315 pass under a folding plowshare to form the cuff 314 by heat-sealing the edge of the margin to the web and secure the lengths of the strip 315 through the holes 317, a pair of punches punch the openings 319 through the web 300 and the strips 315, severing the latter into closure member lengths. The dies by which the strips of stock are severed to provide spaced but aligned lengths of closure strips 315 also form the creases 321 adjacent the ends of the strips, whereby the ends of the strip are angled with respect to their lengths between the creases.

The closure members 315 are thus locked in the cuffs 314 by heat sealing through the holes 317, but the cuffs are open at their ends. To close these cuff ends externally, two folding operations are available: (1) With the convex surface of a strip 315 and opening 319 covered by the folded-over and sealed margins 316, the web 300 is folded on its centerline to bring together the concave faces of the strips 315 on opposite ends of the web 300 and locate the folded-over margins 316 as the external walls of the cuff 314. Transverse heat-sealing cuts 318 bisecting the openings 319 form the end-seams of the resultant pouches, closing the cuffs 314 externally but leaving the ends of the cuffs open internally adjacent the end seams; the corners of the ends of opposed closure strips 315 thus bear directly on each other in a pivotal relationship through the internal cuff openings provided by the holes 319. (2) With the concave faces of the stock from which the closure strips 315 are formed uppermost as the stock is laid on the web 300, the margins 316 are then folded over the stock and adhered to the web by heat-seal seams 313 to form cuffs 314 and the closure strip stock is adhered to the web 300 by heat-seals through the holes 317 while punches sever the stock in lengths of closure strip 315, form the creases 321, and cut out the openings 319. The the cuffs are folded again along the inner edges of the members 315 bringing the prior outer edges of the web 300 to the longitudinal cuff lines 320. The cuffed web is then folded along its longitudinal centerline to bring the concave faces of the closure members 315 together and the portions of the margins 316 not removed by the punched openings 319 are brought into positions overlapping the web 300 adjacent the openings 319. In thereafter sealing and severing the folded web along the cut-off lines 318 the external ends of the cuffs are thereby sealed, but the internal ends of the cuffs are open and permit the corners of the ends of the opposed closure strips to bear directly on each other in the completed pouches. In completing the pouches by forming heat-sealed end seams as pouch lengths are cut off from a web folded by either of the above procedures, the end seams are formed tightly against the ends of the closure strips 315 to prevent lengthwise shifting of the strips which are held against transverse shifting by being tightly enfolded in the cuffs. The holes 317 serve the same additional purposes as the holes 217.

This invention is not to be limited to the specific embodiments and variations disclosed but is subject to being further modified and varied without departing from the spirit and scope of the following claims.

For example, the closure elements for closing a pouch are preferably secured thereto by enclosing the same in cuffs of the pouch material at or adjacent the mouth; this cuff construction provides substantial protection for the user from any sharp edges or burrs on the closure elements while holding the ends of them in a pivotal relationship as they snap apart under end-wise loads. However, especially if the closure elements are formed so as to be substantially free of any such sharp edges or burrs, some economy in the amount of pouch material and in the forming operation may be obtained by eliminating the cuff construction and, instead, securing the closure strips by adhesives or heat-sealing to opposite margins at the mouth of the pouch; when the pouches so constructed are end-sealed, the pairs of adjacent ends of opposed closure elements will still be held by the end seals, but without actual pivot or hinge pins, in a pivotal relationship to each other as the pouch is snapped open by end-wise pressure on the end seals and the pouch snaps closed by relief of such pressure.

What is claimed is:

1. A self-closing, snap-opening pouch comprising flexible heat-sealable film closed at its bottom and sides to provide a mouth portion through which contents may be filled and removed, a pair of flexible closure strips of substantially equal length and equally crowned throughout their lengths so that, of the two major sides of a strip, one is stiffer than the other and there should be a lesser tendency of the strip to flex toward that side under a columnar load, said pair of strips being in substantially over-all parallelism and congruence with respect to each other and with their stiffer sides adjacent, whereby, under a columnar load applied to the ends of the pair, said strips should tend to bow away from each other, said pair of strips being located in the mouth of said pouch substantially parallel to the edge thereof and extending from side to side of said pouch, said closure strips each being connected with said flexible film adjacent said mouth to maintain the corners of the ends of one of said strips in juxtaposition with corresponding corners of ends of the other strip, at least one of said closure strips, adjacent an end thereof, being bent transversely so that the bent end portion extends at an obtuse angle to the stiffer side of said strip whereby, in the absence of endwise pressure on said closure strips, said strips hold said mouth substantially closed and, upon the application of endwise pressure to the ends of the pair of closure strips, said strips bow away from each other and the connection of said closure strips to said flexible film causes said closure strips to bear upon and move pivotally with respect to each other at the corners, only, of said ends when said closure strips bow away from each other.

2. A pouch as defined in claim 1 in which each of the said cuffs is open internally at an end adjacent the side of the pouch, whereby the corners of opposed ends of said closure strips can bear and pivot directly on each other when said strips are subjected to a columnar load to open the mouth of said pouch.

3. A self-closing, snap-opening pouch comprising flexible heat-sealable film closed at its bottom and sides to provide a mouth portion through which contents may be filled and removed, a pair of flexible closure strips of substantially equal length and equally crowned throughout their lengths so that, of the two major sides of a strip, one is stiffer than the other and there should be a lesser tendency of the strip to flex toward that side under a columnar load, said pair of strips being in substantially over-all parallelism and congruence with respect to each other and with their stiffer sides adjacent, whereby, under a columnar load applied to the ends of the pair, said strips should tend to bow away from each other, said pair of strips being located in the mouth of said pouch substantially parallel to the edge thereof and extending from side to side of said pouch, said closure strips each being connected with said flexible film adjacent said mouth to maintain the corners of the ends of one of said strips in juxtaposition with corresponding corners of ends of the other strip whereby, in the absence of endwise pressure on said closure strips, said strips hold said mouth closed and, upon the application of endwise pressure to the ends of the pair of closure strips, to bow said strips away from each other, the connection of said closure strips to said flexible film causes said closure strips to bear upon and move pivotally with respect to each other at the corners, only, of said ends when said closure strips bow away from each other and in which each end of each closure strip is bent at an obtuse angle toward the stiffer side thereof whereby the corners of the ends of said strips bear on each other when said strips are connected to said flexible film at the mouth of said pouch and the balance of said strips between the ends thereof are spaced away from each other.

* * * * *